US005228684A

United States Patent [19]

Levatino

[11] Patent Number: 5,228,684

[45] Date of Patent: Jul. 20, 1993

[54] KINETIC ADAPTER FOR BASEBALL TRAINING MACHINE

[76] Inventor: Samuel R. Levatino, 3608 Woodland Ridge Blvd., Baton Rouge, La. 70816

[21] Appl. No.: 824,526

[22] Filed: Jan. 23, 1992

[51] Int. Cl.[5] ..... A63B 69/40

[52] U.S. Cl. ..... 273/26 R; 273/29 A; 428/93

[58] Field of Search ..... 273/26 R, 29 A, 185 C, 273/185 D, 186 A, 191 B, 193 A, 191 R, 193 R, 193 B, 194 A, 194 B; 428/135, 136, 109, 99, 114, 113, 93, 94, 98, 101, 102, 103, 115

[56] References Cited

U.S. PATENT DOCUMENTS 1,973,424 9/1934 Albera ..... 273/26 R
2,985,452 5/1961 Trippet ..... 273/26 R
3,937,464 2/1976 Zaleuski ..... 273/26 R
4,034,991 7/1977 Oppenheimer ..... 273/186 A
4,592,545 6/1986 Sagedahl ..... 273/26 B
4,629,185 12/1986 Amann ..... 482/113
4,640,268 2/1987 Roberts ..... 128/25 R
4,842,270 6/1989 Lange ..... 272/117
4,876,212 4/1975 Oppenheimer ..... 273/186.1
5,029,852 7/1991 Gilfillan ..... 273/26 R

*Primary Examiner*—Theatrice Brown
*Attorney, Agent, or Firm*—Reginald F. Roberts, Jr.

[57] ABSTRACT

A baseball training machine which simulates the ideal swing of a baseball bat, and which communicates this simulation as a feeling to the trainee. The training bat held by the trainee has freedom of movement, both linear and rotational, in three dimensions and in an infinite number of planes.

5 Claims, 6 Drawing Sheets

KINETIC ADAPTER FOR BASEBALL TRAINING MACHINE

BACKGROUND OF THE INVENTION

The present invention relates to a training device. More particularly, the present invention relates to a mechanical device for training a baseball batter.

At present the training available for properly and expertly batting a baseball is restricted to either manual instruction or mechanical devices which are constructed and designed to teach by rote memory or by trial and error. There does not exist in the prior art any device which allows the trainee to actually feel the way he or she should swing a baseball bat for maximum advantage. But it is virtually impossible to teach the trainee efficiently by either prior-art method. What is needed is a device which will simulate the ideal swing, and which will simultaneously communicate this simulation as a feeling to the trainee. The present invention provides such a machine.

SUMMARY OF THE INVENTION

In general, the present invention in one aspect provides a kinetic adapter. In a first embodiment, the kinetic adapter comprises first, second, and third kinetic members, and a connecting member. The first kinetic member has a first opening therein for slidably and rotatably mounting the first kinetic member on a first elongated member. The first opening defines a first axis of rotation of the first kinetic member. The second kinetic member has a second opening therein defining a second axis of rotation. The third kinetic member has a third opening therein defining an axis of rotation identical with the second axis of rotation. The connecting member rotatably connects the second and third kinetic members along the second axis of rotation. The fourth kinetic member has a fourth opening therein for the disposition within the fourth opening of an end of a second elongated member. The fourth opening defines a third axis of rotation of the second elongated member. The first and second axes of rotation are substantially perpendicular to one another, and the second and third axes of rotation are substantially perpendicular to one another.

In a second embodiment, the kinetic adapter comprises first and second kinetic members fastened to one another in a perpendicular configuration. The first kinetic member has a first opening therein for slidably and rotatably mounting the first kinetic member on a first elongated member. The first opening defines a first axis of rotation of the first kinetic member. The second kinetic member has a second opening therein for the disposition within the second opening of an end of a second elongated member. The second opening defines a second axis of rotation of the second elongated member. The first and second axes of rotation are substantially perpendicular to one another.

In a third embodiment, the kinetic adapter comprises first, second, and third kinetic members, and a connecting member. The first kinetic member has a first opening therein for slidably and rotatably mounting the first kinetic member on a first elongated member. The first opening defines a first axis of rotation of the first kinetic member. The second kinetic member has a second opening therein defining a second axis of rotation. The third kinetic member has a ball and socket therein for the disposal within the socket of an end of a second elongated member. The socket defines a third axis of rotation of the second elongated member. The connecting member rotatably connects the second and third kinetic members to one another along the second axis of rotation. The first and second axes of rotation are substantially perpendicular to one another, and the second and third axes of rotation are substantially perpendicular to one another.

In a second aspect, the present invention provides a baseball training machine. In a first embodiment, the training machine comprises a frame which includes a horizontal base, with first and second perforated vertical members fastened to the base. First and second perforated sheaths are constructed and arranged such that perforations in the first and second sheaths are alignable with perforations in the first and second vertical members, respectively.

The machine further comprises an adjustable cross-member having first and second ends defining a longitudinal axis. First and second pillow block bearings are fastened to the first and second sheaths. The first and second ends of the adjustable cross-member are disposed in and supported by the first and second pillow block bearings. First and second pins are inserted in the aligned perforations of the first and second sheaths and the first and second vertical members, to fix the elevation and inclination of the adjustable cross-member. The first and second pillow block bearings and the cross-member are so constructed and arranged that the cross-member is rotatable about its longitudinal axis in the pillow block bearings.

A kinetic adapter is slidably and rotatably mounted on the adjustable cross-member. The kinetic adapter comprises first, second, third, and fourth kinetic members, and a connecting member. The first kinetic member has a first opening therein for slidably and rotatably mounting the first kinetic member on the adjustable cross-member. The first opening defines a first axis of rotation of the first kinetic member which is identical with the longitudinal axis of the adjustable cross-member. The second kinetic member has a second opening therein defining a second axis of rotation. The third kinetic member has a third opening therein defining an axis of rotation identical with the second axis of rotation. The connecting member rotatably connects the second and third kinetic members along the second axis of rotation. The fourth kinetic member has a fourth opening therein for the disposition within the fourth opening of a first end of a rigid elongated member having first and second ends. The fourth opening defines a third axis of rotation of the rigid elongated member. The first and second axes of rotation are substantially perpendicular to one another, and the second ad third axes of rotation are substantially perpendicular to one another.

A training bat comprises the rigid elongated member, the second end of the rigid elongated member serving as a handle for the training bat.

The first, second, third, and fourth kinetic members and the connecting member cooperate with one another to provide for the training bat freedom of movement, both linear and rotational, in three dimensions and in an infinite number of planes.

The machine further comprises a cable having first and second ends. The first end of the cable is attached to the first end of the rigid, elongated member. The cable is disposed in a friction less ball-bearing pulley mounted on the frame. An adjustable weight is attached to the second end of the cable, to provide variable amounts of tension so as to build muscle of ever-increasing strength, and to augment the feel of a correct swing of the training bat.

The machine further comprises adjustable first and second stop members, for delimiting the length of a swing of the training bat. The first stop member determines the beginning of the swing, and the second stop member determines the end of the swing.

In a second embodiment, the training machine comprises a frame including a horizontal base, with first and seoond perforated vertical members fastened to the base. First and second perforated sheaths are constructed and arranged such that perforations in the first and second sheaths are alignable with perforations in the first and second vertical members, respectively.

The machine further comprises an adjustable cross-member having first and second ends defining a longitudinal axis. First and second flexible pillow block bearings are provided for attaching the first and second ends of the adjustable cross-member to the first and second perforated sheaths, respectively. First and second pins are inserted in the aligned perforations of the first and second sheaths and the first and second vertical members, to fix the elevation and inclination of the adjustable cross-member.

A kinetic adapter is slidably and rotatably mounted on the adjustable cross-member. The kinetic adapter comprises first and second kinetic members fastened to one another in a substantially perpendicular configuration. The first kinetic member has a first opening therein for slidably and rotatably mounting the first kinetic member on the adjustable cross-member. The first opening defines a first axis of rotation of the first kinetic member which is identical with the longitudinal axis of the adjustable cross-member. The second kinetic member has a second opening therein for the disposition within the second opening of an end of an elongated member. The second opening defines a second axis of rotation of the elongated member. The first and second axes of rotation are substantially perpendicular to one another. A first rigid elongated member having first and second ends has its first end disposed in the rotary flange bearing. A second rigid elongated member has first and second ends. A flexible member connects the second end of the first elongated member to the first end of the second elongated member to form a training bat having a longitudinal axis. The second end of the training bat serves as a handle for the bat. The kinetic adapter is so constructed and arranged that the longitudinal axes of the adjustable cross-member and the training bat are substantially perpendicular to one another.

The first kinetic member is capable of both linear movement and rotational movement. The second kinetic member allows both limited linear movement of the first elongated member and rotational movement of the first elongated member inside the second kinetic member. The flexible member maximizes freedom of movement of the wrist and arm of a baseball trainee using the training machine.

The machine further comprises a cable having first and second ends. The first end of the cable is attached to the first rigid elongated member. The cable is disposed in a friction less ball-bearing pulley. An adjustable weight is attached to the second end of the cable, to provide variable amounts of tension so as to build muscle of ever-increasing strength, and to augment the feel of a correct swing of the training bat.

The machine further comprises adjustable first and second stop members, for delimiting the length of a swing of the training bat. The first stop member determines the beginning of the swing, and the second stop member determines the end of the swing.

In a third embodiment, the training machine comprises a frame including a horizontal base, with first and second perforated vertical members fastened to the base. First and second perforated sheaths are constructed and arranged such that perforations in the first and second sheaths are alignable with perforations in the first and second vertical members, respectively.

The machine further comprises an adjustable cross-member having first and second ends defining a longitudinal axis. First and second flexible pillow block bearings are provided for attaching the first and second ends of the adjustable cross-member to the first and second perforated sheaths, respectively. First and second pins are inserted in the aligned perforations of the first and second sheaths and the first and second vertical members, to fix the elevation and inclination of the adjustable cross-member.

A kinetic adapter is slidably and rotatably mounted on the adjustable cross member. The kinetic adapter comprises first, second, and third kinetic members, and a connecting member. The first kinetic member has a first opening therein for slidably and rotatably mounting the first kinetic member on the adjustable cross-member. The first opening defines a first axis of rotation of the first kinetic member which is identical with the longitudinal axis of the adjustable cross-member. The second kinetic member has a second opening therein defining a second axis of rotation. The third kinetic member has a ball and socket therein for disposal within the socket of a first end of an elongated rigid member which has first and second ends and a longitudinal axis, and which serves as a training bat. The second end of the elongated rigid member serves as the bat handle. The connecting member rotationally connects the second and third kinetic members to one another along the second axis of rotation. The kinetic adapter is so constructed and arranged that the longitudinal axes of the adjustable cross-member and the bat are mutually perpendicular, and the longitudinally axis of the bat is identical with an axis of rotation defined by the socket disposed within the ball.

The first longitudinal axis and second axis of rotation are substantially perpendicular to one another, and the second axis of rotation and the second longitudinal axis are substantially perpendicular to one another.

The first, second, and third kinetic members and the connecting member cooperate with one another to provide for the training bat freedom of movement, both linear and rotational, in three dimensions and in an infinite number of planes.

The machine further comprises a cable having first and second ends. The first end of the cable is attached to the first end of the rigid, elongated member. The cable is disposed in a friction less ball-bearing pulley mounted on the frame. An adjustable weight is attached to the second end of the cable, to provide variable amounts of tension so as to build muscle of ever-increasing strength, and to augment the feel of a correct swing of the training bat.

The machine further comprises adjustable first and second stop members, for delimiting the length of a swing of the training bat. The first stop member determines the beginning of the swing, and the second stop member determines the end of the swing.

DETAILED DESCRIPTION OF THE INVENTION

Figure 1:
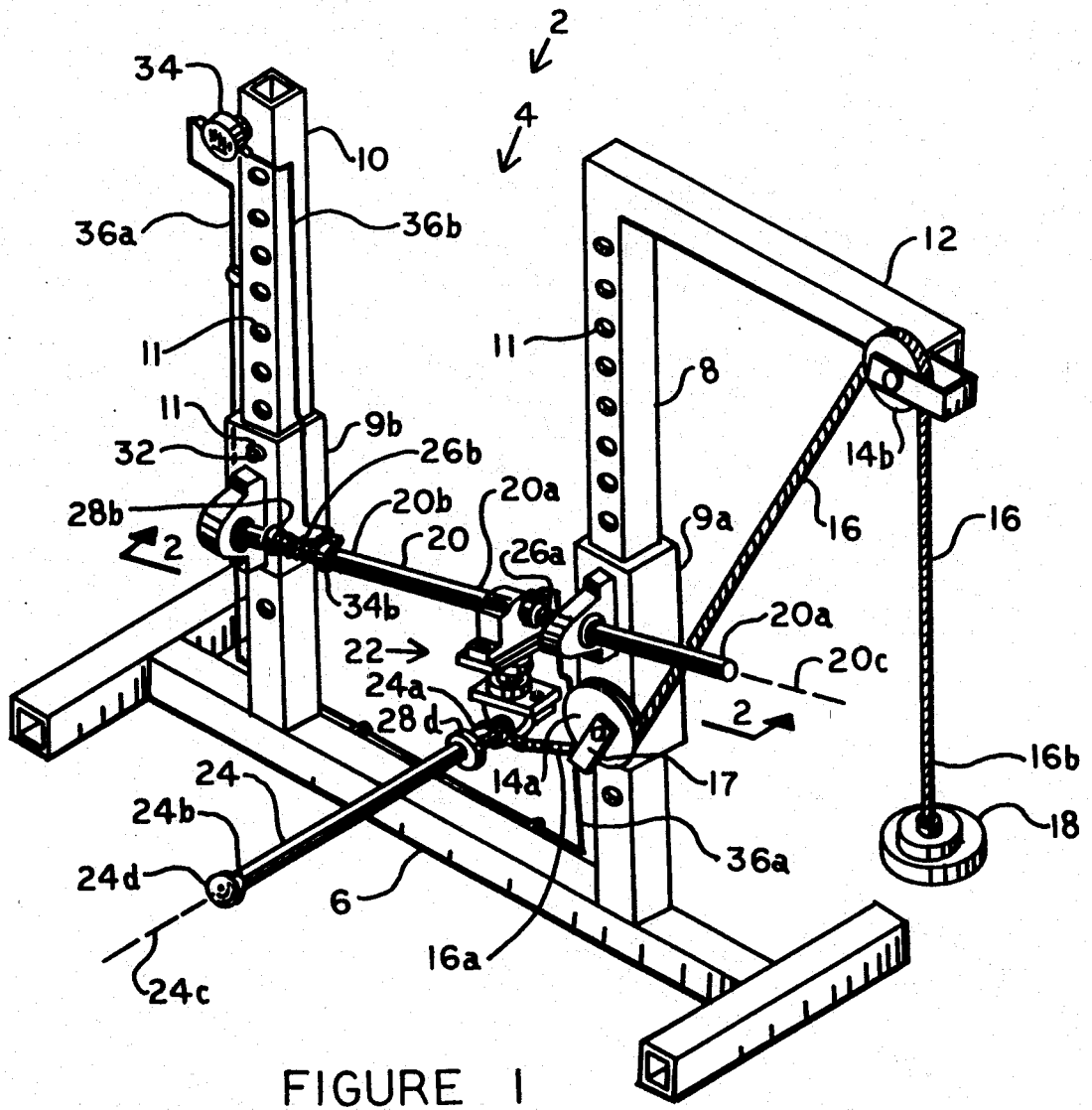
FIG. 1 is a schematic representation of a first embodiment of a baseball training machine, made in accordance with the principles of the present invention, and generally designated by the numeral 2.
Figure 2:
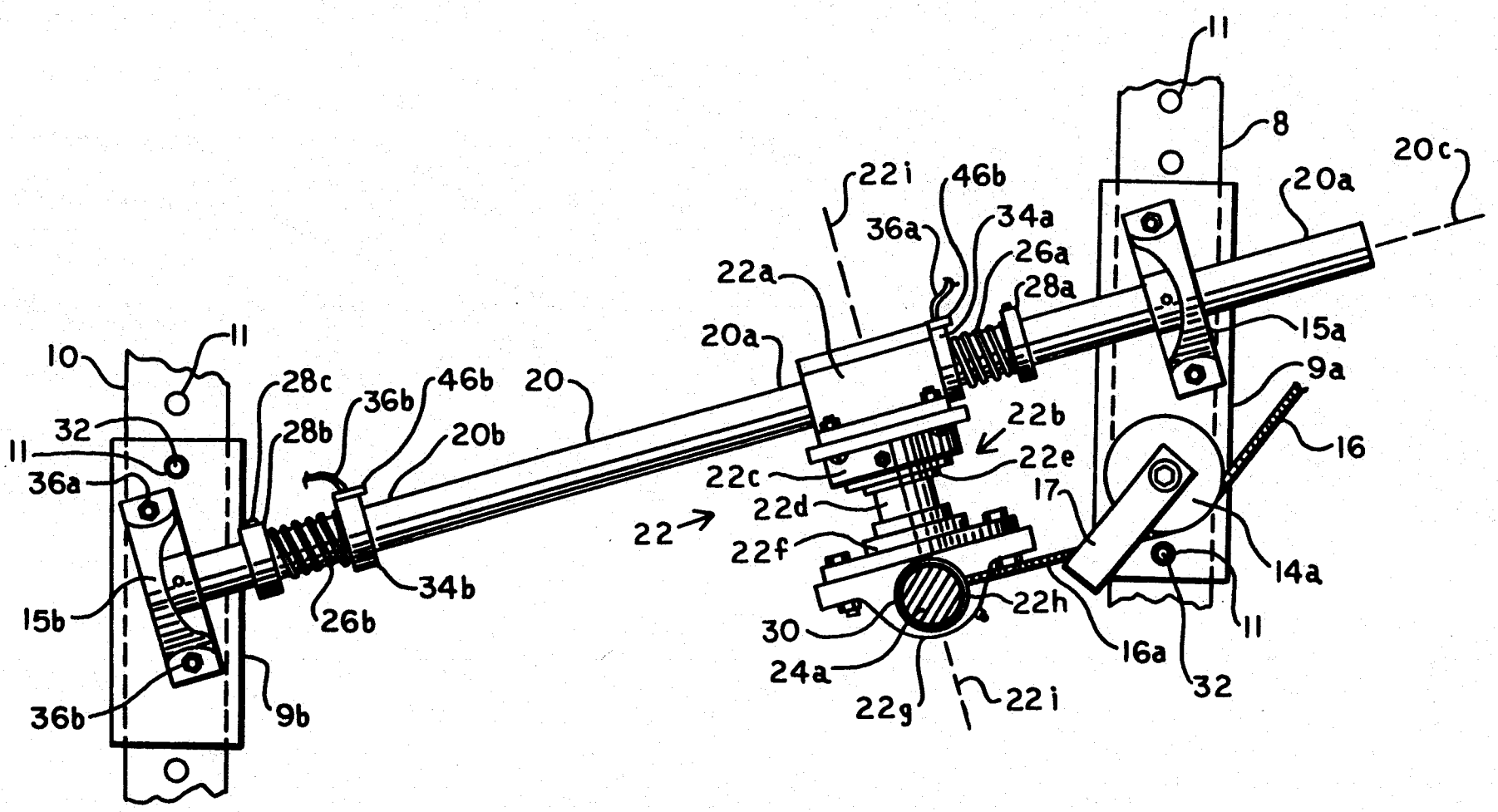
FIG. 2 is a partial cross-sectional view of the machine shown in FIG. 1, taken along the cutting line 2—2.

More specifically, reference is made to FIGS. 1 and 2, in which is shown a first an preferred embodiment of a baseball training machine, made in accordance with the principles of the present invention, and generally designated by the numeral 2.

The raining machine 2 includes a frame 4 having a horizontal base 6, first and second perforated vertical members 8 and 10, and a horizontal arm 12 extending from the first vertical member 8.

First and second perforated sheaths 9*a* and 9*b* surround the first and second vertical members 8 and 10 over part of the lengths of the vertical members. Perforations 11 in the vertical members 8 and 10 are alignable with perforations 11 in the sheaths 9*a* and 9*b*, whereby the sheaths 9*a* and 9*b* may be fixed at a particular elevation, as hereinafter explained.

First and second flexible pillow block bearings 15*a* and 15*b* are fastened to the first and second sheaths 9*a* and 9*b*. An adjustable elongated and rigid cross-member 20 has first and second ends 20*a* and 20*b* which define a longitudinal axis 20*c*. The adjustable cross-member 20 is preferably cylindrical. The first end 20*a* of the adjustable cross-member 20 is disposed in and supported by the first pillow block bearing 15*a*; the second end 20*b* of the adjustable cross-member 20 is disposed in and supported by the second pillow block bearing 15*b*. The first and second pillow block bearings 15*a*, 15*b* and the cross-member 20 are so constructed and arranged that the cross-member 20 is capable of rotation in the pillow block bearings 15*a*, 15*b* about the longitudinal axis 20*c* of the adjustable cross-member 20.

First and second annular stop members 28*a*, 28*b* and first and second springs 26*a*, 26*b* are mounted on the adjustable cross-member 20. Between the first and second springs 26*a* and 26*b* a kinetic adapter 22 is slidably and rotatably mounted on the cross-member 20. A training bat comprising a rigid, elongated member 24 having first and second ends 24*a*, 24*b* is journalled in the kinetic adapter 22. The first end 24*a* of the training bat is attached to the kinetic adapter 22, and the second end 24*b* serves as a handle for the training bat 24. A knob 24*d* of rubber or the like protects the second end 24*b* of the training bat 24 from slipping. The first and second ends 24*a* and 24*b* define a longitudinal axis 24*c* of the training bat 24. The training bat 24 is preferably cylindrical.

A cable 16 having first and second ends 16*a*,16*b* is disposed in first and second friction less pulleys 14*a* and 14*b*. The first pulley 14*a* is mounted on the first sheath 9*a*; the second pulley 14*b* is mounted on the horizontal arm 12. The first end 16*a* of the cable is connected to the first end 24*a* of the bat 24. An adjustable weight 18 is attached to the second end 16*b* of the Cable 16.

The pillow block bearings 15*a* and 15*b* are fastened to the sheaths 9*a* and 9*b* by nuts 30*a* and bolts 30*b*. The stop members 28*a* and 28*b* are secured to the adjustable cross-member 20 by Allen screws 28*c* which, when loosened, allow the members 28*a* and 28*b* to slide along the cross-member 20 and be refastened at any point along the cross-member.

Figure 3:
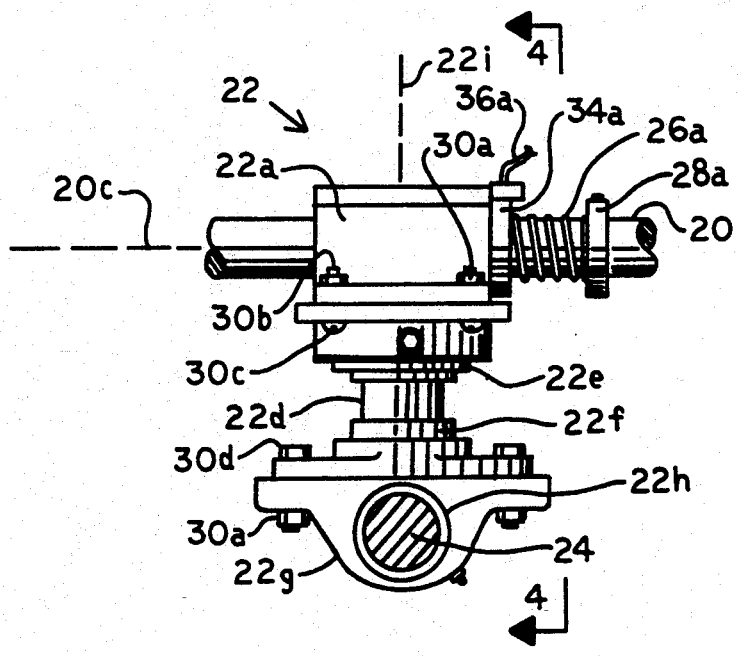
FIG. 3 is an enlarged view of a portion of the training machine shown in FIG. 2.
Figure 4:
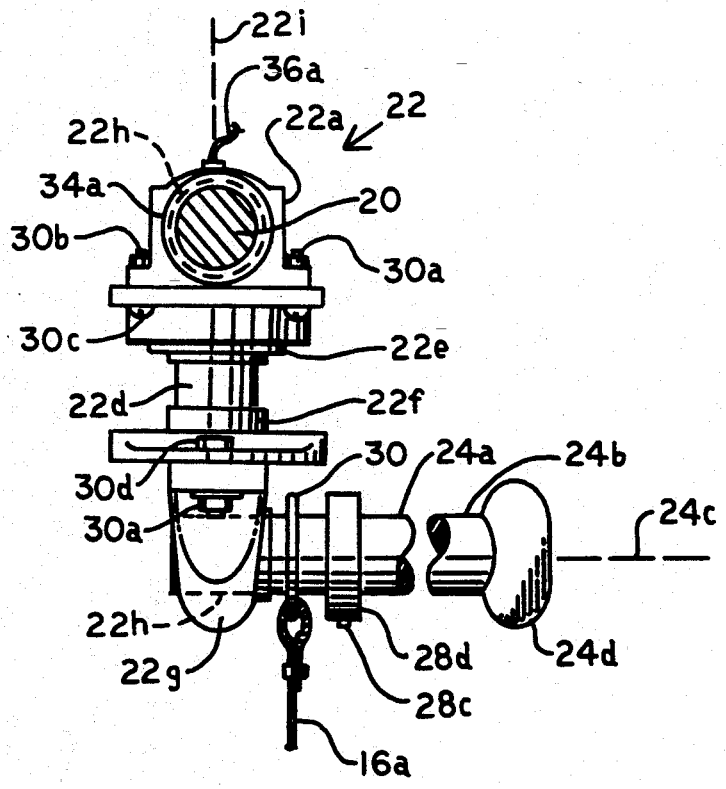
FIG. 4 is a cross-sectional view of the portion of the machine shown in FIG. 3, taken along the cutting line 4—4.

Reference is now made to FIGS. 3 and 4, in which is shown the detailed structure of the kinetic adapter 22 and of the attachment of the cable 16 to the training bat 24.

The kinetic adapter 22 comprises a linear ball bearing 22*a*, a first rotary flange bearing 22*e*, a connecting member 22*d* having a rotational axis 22*i*, a second rotary flange bearing 22*f*, and a third flexible pillow block bearing 22*g*. The first rotary flange bearing 22*e* is fastened to the linear ball bearing 22*a* by nuts 30*a* and bolts 30*b*, 30*c*. The connecting member 22*d* enables the second rotary flange bearing 22*e* and the third flexible pillow block bearing 22*g* to rotate about the axis 22*i*. The third flexible pillow block bearing 22*g* is fastened to the second rotary flange bearing 22*f* with nuts 30*a* and bolts 30*d*. The third flexible pillow block bearing 22*g* includes an opening 22*h* for the disposal therein of the first end 24*a* of the training bat 24. The opening 22*h* defines a rotational axis which is identical with the longitudinal axis 24*c* of the bat 24. The linear ball bearing 22*a*, first and second rotary flange bearings 22*e* and 22*f*, connecting member 22*d*, and third flexible pillow block bearing 22*g* cooperate with one another to provide for the training bat 24 freedom of movement, both linear and rotational, in three dimensions and in an infinite number of planes.

The first end 16*a* of the cable 16 is secured to the first end 24*a* of the bat 24 by a ring 30 which encircles the first end 24*a* of the bat 24. The ring 30 is confined to the first end 24*a* of the bat 24 by a third annular stop member 28*d*. The third stop member 28*d* is adjustably attached to the first end 24*a* of the bat 24 by an Allen screw 28*c*.

Figure 5:
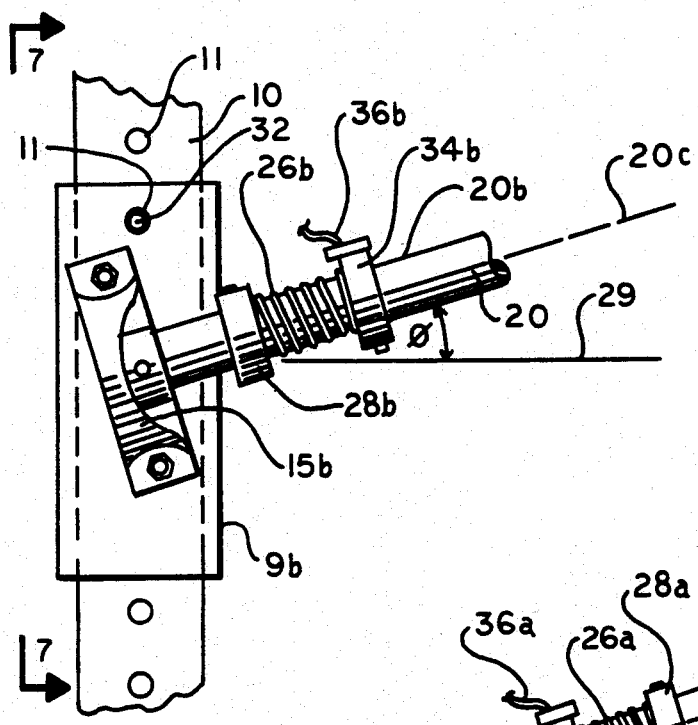
FIG. 5 is an enlarged view of a first portion of the machine shown in FIG. 1.
Figure 6:
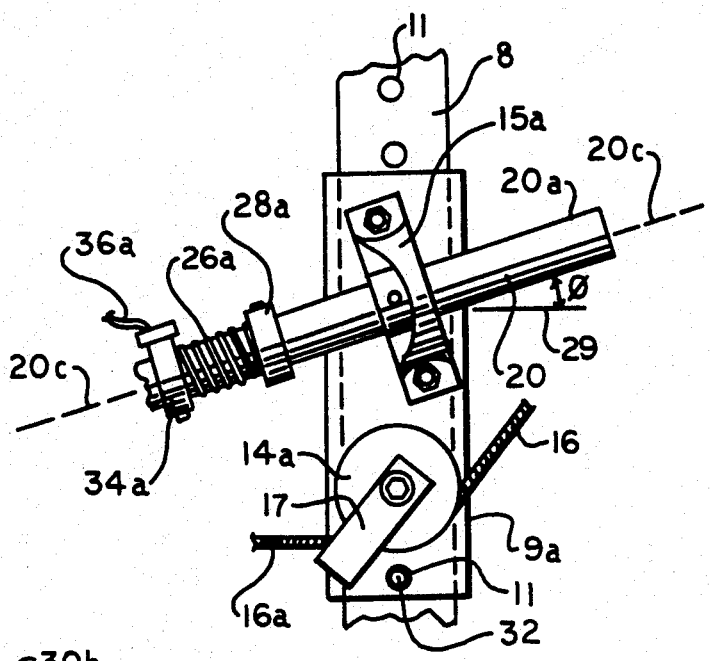
FIG. 6 is an enlarged view of a second portion of the machine shown in FIG. 1.

Reference is now made to FIGS. 5 and 6, in which are shown structural details of portions of the baseball training machine 2. The adjustable cross-member 20 defines an angle $\theta$ with a horizontal plane 29. The value of $\theta$ is from about forty degrees above the horizontal plane 29 to about forty degrees below the horizontal plane 29. Preferably, the value of $\theta$ is from about twenty degrees above to about twenty degrees below the horizontal plane 29.

Figure 7:
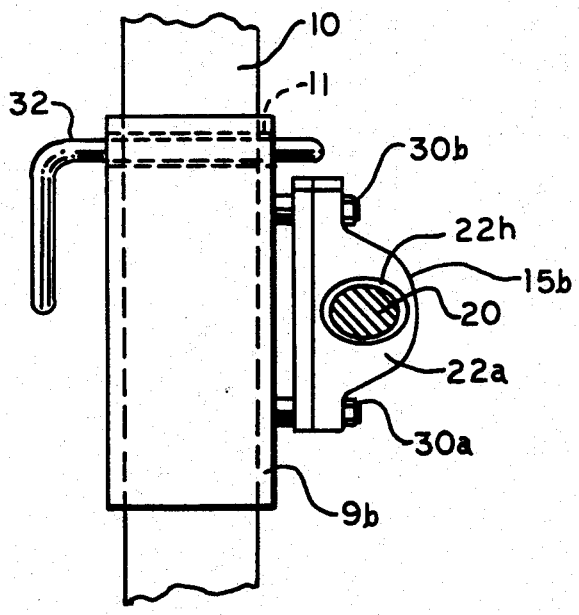
FIG. 7 is a cross-sectional view of the first portion of the machine shown in FIG. 5, taken along the cutting line 7—7.

Reference is now made to FIG. 7, in which are shown structural details of the manner of attachment of the second sheath 9b to the second vertical member 10. The elevation of the second sheath 9b is fixed by inserting a pin 32 through the aligned perforations 11 of the sheath 9b and the vertical member 10. In a similar manner the elevation of the first sheath 9a is fixed by inserting a second pin 32 through the aligned perforations 11 of the sheath 9a and the first vertical member 8. These two operations fix both the of the adjustable cross-member 20.

The length of the training bat 24 is from about twenty-eight to about thirty-eight inches, in order to simulate a regulation baseball bat, which has a length of thirty-four inches. Preferably, the length of the training bat 24 is from about thirty-two to about thirty-six inches The length of the adjustable cross-member 20 is from about three to about five feet.

The length of the vertical members 8 and 10 is from about four to about six feet.

Preferably, the vertical members 8 and 10 and the sheaths 9a and 9b are made from tubing. Even more preferably, they are made from square tubing.

The dimensions of the pillow block bearings 15a and 15b are preferably about one inch internal diameter (1" ID).

The perforations 11 in the sheaths 9a, 9b and the vertical members 8, 10 are from about three-eighths to about three-fourths of an inch in breadth. Preferably, the perforations 11 are from about three-eighths to about one-half of an inch in breadth. Even more preferably, the perforations 11 are substantially circular.

The distance separating the individual perforations 11 from one another is from about three-fourths of an inch to about one and one-half inches.

While the inclination of the adjustable cross-member 20 may be horizontal or oblique, it is preferably oblique with a slight downward slope from the first vertical member 8 to the second vertical member 10, as shown in FIGS. 5 and 6.

The manner of operating and using the training machine 2 is generally as follows.

The trainee grasps the handle 24b of the training bat 24, and starts his or her swing. The start of the swing is determined by the position of the first spring 26a and the first stop member 28a. From this starting position, the kinetic adapter 22 travels on a path along the adjustable cross-member 20 until the adapter 22 strikes the second spring 26b and is stopped by the second stop member 28b, thereby ending the swing. This procedure eliminates the need for a totally separate drill in which a trainee hits a tire with a baseball bat.

Preferably, and referring to FIGS. 1 and 2, the period of the swing is measured by means of an automatic timer 34. A first wire 36a electrically connects the timer 34 to a third stop member 34a. A second wire 36b electrically connects the timer 34 to a fourth stop member 34b. Switching means 46a and 46b shown in FIG. 11 start and stop the timer 34 at the beginning and end of a swing by connecting and disconnecting the timer 34 from a source of electrical power 52.

Figure 10:
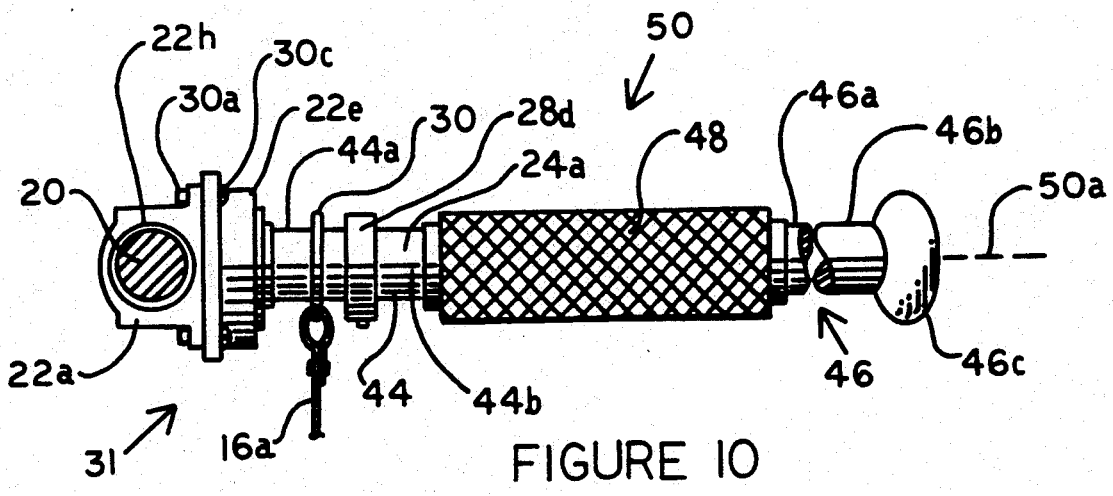
FIG. 10 is a schematic representation of a portion of a third embodiment of a baseball training machine, made in accordance with the principles o the present invention.

Reference is now made to FIG. 10, wherein is shown a portion of a second embodiment of a baseball training machine, made in accordance with the principles of the present invention. In the second embodiment of the training machine, a kinetic adapter 31 comprises a linear ball bearing 22a fastened to a rotary flange bearing 22e in a perpendicular configuration. The linear ball bearing 22a is slidably and rotatably mounted on the adjustable cross-member 20 (FIG. 1).

A first rigid elongated member 44 having first and second ends 44a, 44b has its first end 44a disposed in the rotary flange bearing 22e. A second rigid elongated member 46 has first and second ends 46a , 46b. A flexible member 48 connects the second end 44b of the first elongated member 44 to the first end 46a of the second elongated member 46 to form a training bat 50 having a longitudinal and rotational axis 50a. The second end 46b of the second elongated member 46 serves as a handle for the bat 50, and may beneficially terminate in a flange-like knob 46c.

The overall length of the training bat 50 is from about twenty eight to about thirty-eight inches, in order to simulate a thirty-four-inch regulation baseball bat. Preferably, the length of the training bat 50 is from about thirty-two to about thirty-six inches. Even more preferably, the length of the first rigid elongated member 44 is less than that of the second rigid elongated member 46. The construction of the bat 50 and of the kinetic adapter 31 permits freedom of movement of the bat 50 in multiple planes.

The linear ball bearing 22a can move not only in a linear direction, but can also twist in a rotational direction. The rotary flange bearing 22e not only allows limited linear movement of the training bat 50, but also allows rotational movement of the bat within the bearing. Furthermore, the flexible member 48 maximizes freedom of movement of the wrists and arms while totally controlling the path of the first elongated member (bathed) 44.

The only difference between the first and second embodiments of the, baseball training machine resides in the replacement of the kinetic adapter 22 and training bat 24 with the kinetic adapter 31 and the training bat 50. The remaining parts of the first embodiment 2 (FIG. 1) are unchanged.

Figure 8:
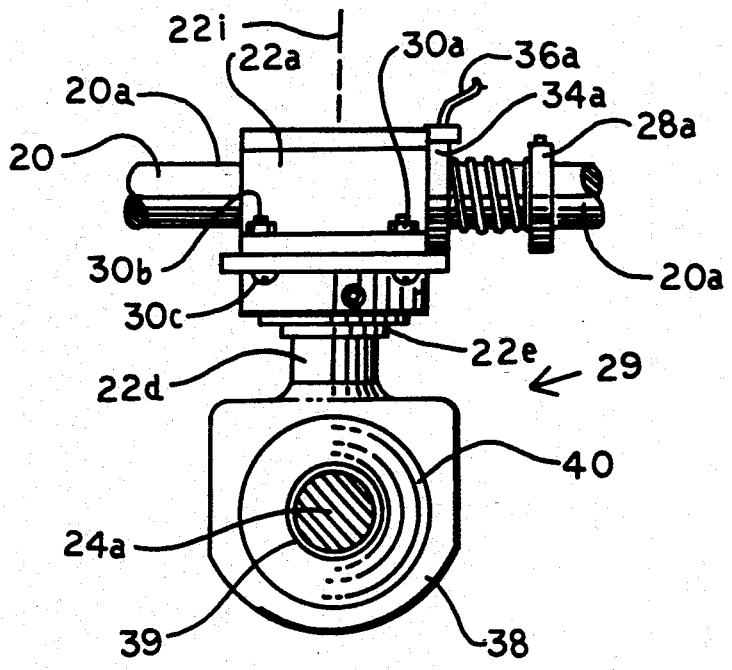
FIGS. 8 and 9 are schematic representations of a portion of a second embodiment of a baseball training machine, made in accordance with the principles of the present invention.
Figure 9:
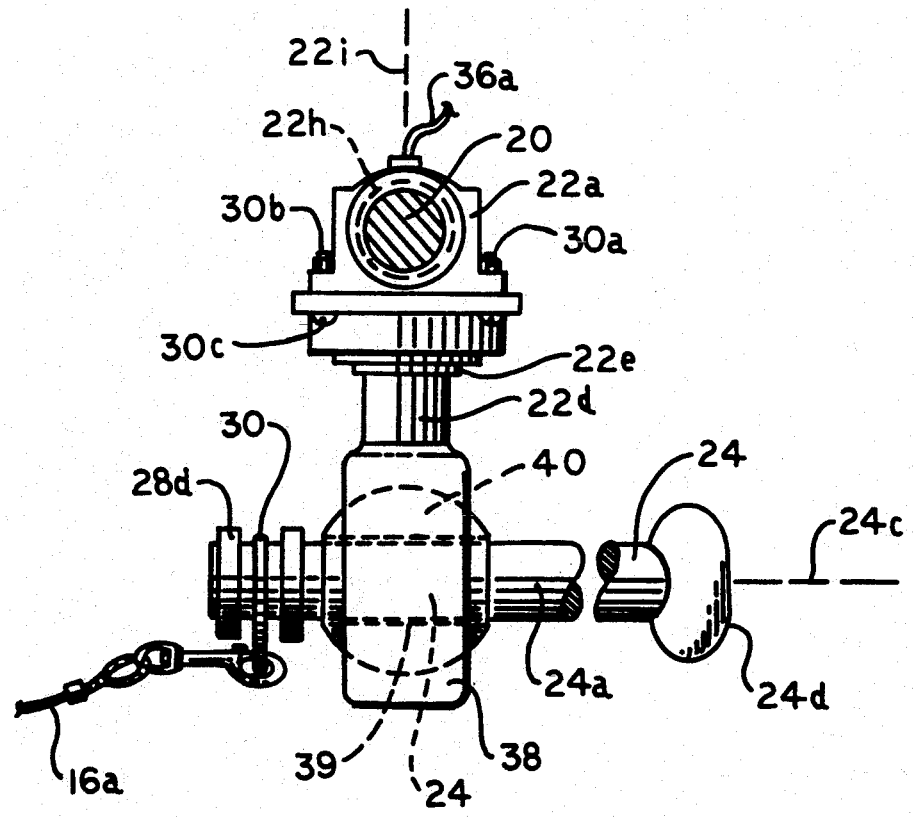

Reference is now made to FIGS. 8 and 9, in which is shown a portion of a third and most preferred embodiment of a baseball training machine, made in accordance with the principles of the present invention. In the third embodiment of the training machine, a kinetic adapter 29 is slidably and rotatably mounted on the adjustable cross-member 20 (FIG. 1). The kinetic adapter 29 comprises a linear ball bearing 22a, a rotary flange bearing 22e, and a rod-end spherical bearing 38. All of the bearings include flanges. The linear ball bearing 22a is slidably and rotatably mounted on the cross-member 20. The flange of the rotary flange bearing 22a is fastened to the flange of the linear ball bearing 22a, and the rod-end spherical bearing 38 is rotatably connected to the rotary flange bearing 22e by a connecting member 22d having an axis of rotation 22i. The rod-end spherical bearing 38 includes a ball 40 having therein a socket 39 for receiving the first end 24a of the training bat 24 used with the first embodiment 2 of the training machine (FIG. 1). The bat 24 is freely rotatable about its longitudinal axis 24c in the socket 39. The remaining parts of the first embodiment 2 (FIG. 1) are unchanged. The linear ball bearing 22a, rotary flange bearing 22e, connecting member 22d, and rod-end spherical bearing 38 cooperate with one another to provide for the training bat 24 freedom of movement, both linear and rotational, in three dimensions and in an infinite number of planes.

Figure 11:
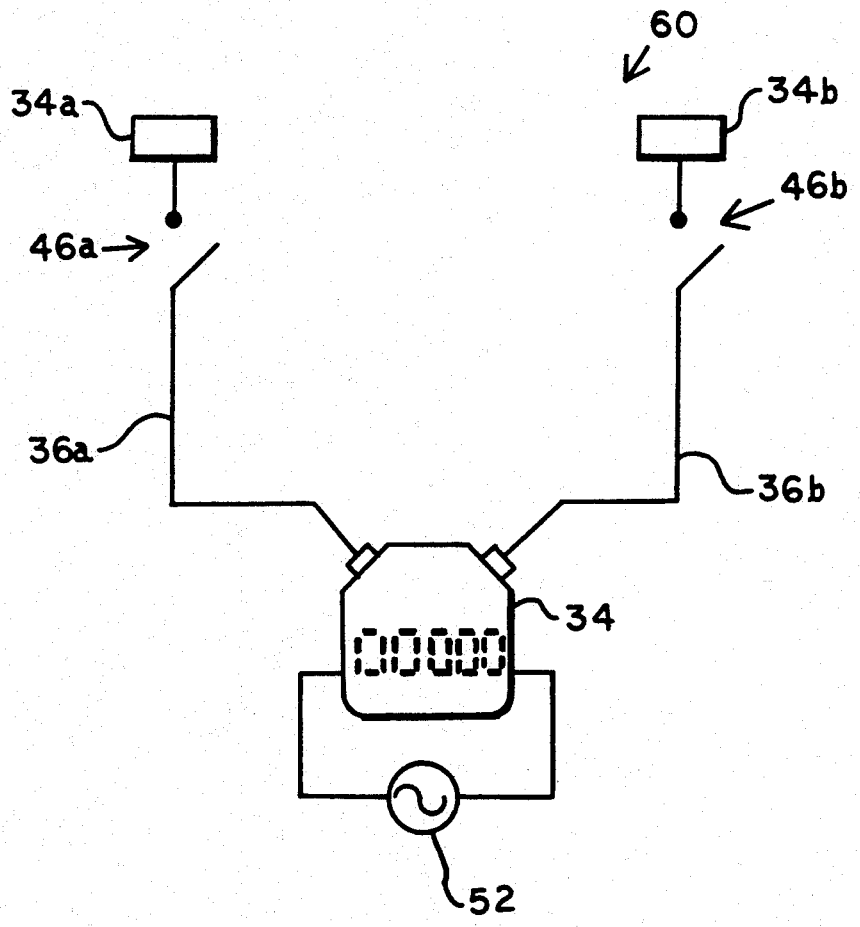
FIG. 11 is a wiring diagram of a timing mechanism made in accordance with the principles of the present invention.

Reference is now made to FIG. 11, in which is shown a wiring diagram of a timing mechanism made in accordance with the principles of the present invention, and generally designated by the numeral 60.

The timing mechanism 60 comprises the timer 34; the source of electrical power 52; the stop members 34*a* and 34*b*; the wires 36*a* and 36*b*; and switches 46*a* and 46*b*. The source of electrical power 52 is preferably a 110–120 volt alternating current (110–120 VAC) outlet. It may, however, be a storage battery.

I claim:

1. A kinetic adapter, comprising:

(a) a first kinetic member having a first flange, and having a first opening in the first kinetic member for slidably and rotatably mounting the first kinetic member on a first elongated member, the first opening defining a first axis of rotation of the first kinetic member;

(b) a second kinetic member having a second flange, and having a second opening in the second kinetic member defining a second axis of rotation, the first and second flanges being fastened to each other, thereby fastening the first and second kinetic members to one another;

(c) a third kinetic member having a ball and socket, for the disposal within the socket of an end of a second elongated member, the socket defining a third axis of rotation of the second elongated member; and (d) a connecting member rotatably connecting the second and third kinetic members to one another along the second axis of rotation;

the first and second axes of rotation being substantially perpendicular to one another, and the second and third axes of rotation being substantially perpendicular to one another.

2. The kinetic adapter of claim 1, wherein:

(e) the first kinetic adapter is a linear ball bearing;

(f) the second kinetic adapter is a rotary flange bearing; and (g) the third kinetic adapter is a rod-end spherical bearing.

3. A baseball training machine, comprising:

(a) a frame;

(b) a straight, rigid, elongated, substantially horizontal first member mounted on the frame;

(c) a linear bearing mounted on the elongated horizontal member, the bearing and the horizontal member being constructed and arranged so that the bearing can move linearly along the elongated member and rotatably around the elongated member about a first axis of rotation;

(d) a second member having a ball and socket, for the disposal within and attachment to the socket of one end of a baseball training bat; and (e) means for connecting the second member to the linear bearing so that the training bat has freedom of movement, both linear and rotational, in three dimensions and in an infinite number of planes.

4. The baseball training machine of claim 3, wherein the means for connecting the second member to the linear bearing include (e1) a first flange for the linear bearing;

(e2) a first connecting member having a second flange, and a second axis of rotation substantially perpendicular to the first axis of rotation defined by the linear bearing, the first flange of the linear bearing being fastened to the second flange of the first connecting member, thereby connecting the linear bearing to the first connecting member; and (e3) a second connecting member rotatably connecting the first connecting member o the second member.

5. The baseball training machine of claim 3, wherein the first connecting member is a rotary flange bearing, and the second connecting member is a rod-end spherical bearing.

* * * * *